United States Patent [19]

Voss

[11] Patent Number: 4,843,923

[45] Date of Patent: Jul. 4, 1989

[54] FASTENER-HANDLING TOOL

[75] Inventor: Raymond G. Voss, Bettendorf, Iowa

[73] Assignee: Eagle Valley Manufacturing, Inc., Eldridge, Iowa

[21] Appl. No.: 234,762

[22] Filed: Aug. 22, 1988

[51] Int. Cl.[4] ..... B25L 3/00

[52] U.S. Cl. ..... 81/44

[58] Field of Search ..... 81/44, 23, 487, 3.8; 7/169, 170; 294/99.1, 99.2

[56] References Cited

U.S. PATENT DOCUMENTS

| | | | |
|---|---|---|---|
| 1,521,689 | 1/1925 | King | 294/99.2 |
| 2,799,860 | 7/1957 | Myers | 81/44 |
| 3,060,442 | 10/1962 | Tomek | 81/44 |
| 3,286,559 | 11/1966 | Terrell et al. | 294/99.2 |

*Primary Examiner*—Debra Meislin

*Attorney, Agent, or Firm*—Henderson & Sturm

[57] ABSTRACT

The fastener-handling tool disclosed is for the purpose of assisting in the starting of pointed fasteners such as nails, brads, tacks, screws and the like in instances where it is difficult or impossible for a person to hold the fastener conveniently between his thumb and forefinger while driving the fastener with, for example, a hammer, screw-driver, etc. The tool comprises a one-piece molded elastomer element in which the handle part of convenient size has attached thereto a slender finger which is of substantially reduced cross-section and which has a hole at its free end for receiving the fastener. A slot leads cross-wise to the hole to enable the finger to be separated from the partially-driven fastener in a direction radial to the fastener. By way of an added feature, the handle part includes a pin cushion for carrying a supply of fasteners.

2 Claims, 1 Drawing Sheet

Fig. 1
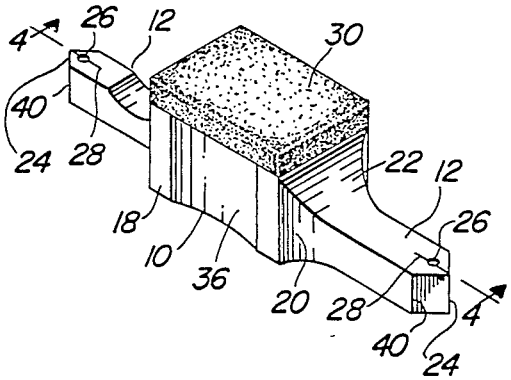
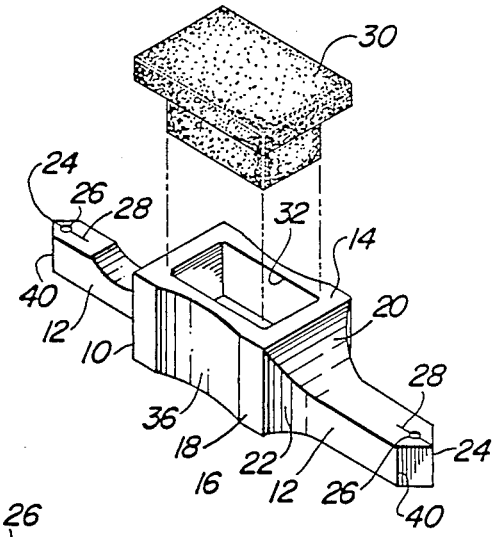
Fig. 2
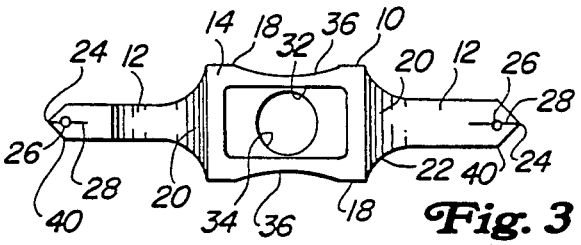
Fig. 3
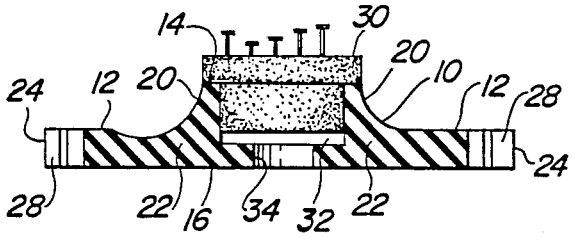
Fig. 4
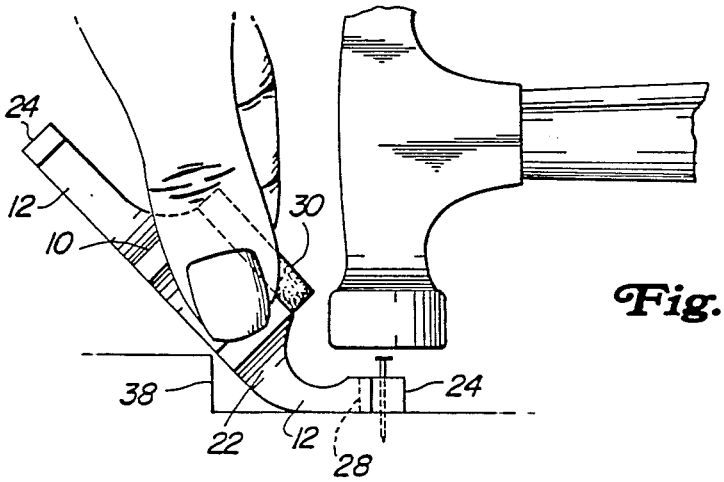
Fig. 5

FASTENER-HANDLING TOOL

BACKGROUND AND GENERAL NATURE OF THE INVENTION

It is common knowledge that the driving of small fasteners is a difficult task and resort has often been had to auxiliary tools such as needle-nose pliers, for example, especially in tight areas where a person's fingers cannot conveniently reach, whether the fastener be a nail, tack, staple, screw or the like. It is therefore a principal object of the invention to provide a simple and inexpensive tool that eliminates the difficulties of handling fasteners. The tool may also be used to handle large fasteners in tight places, and the construction features a fastener holding finger which is flexible relative to a handle part and thus enabled to be used in areas involving offsets from, say, horizontal or vertical planes. A further feature of the invention is the provision of means for carrying a supply of additional fasteners for easy access at the job site. Still further, the means for carrying additional fasteners is of such material as to function in the manner of a pin cushion and is provided as a removable element carried in a cavity in the handle part. The element may be easily removed by forcing it upwardly and outwardly via a communicating hole in the bottom of the handle part.

The foregoing and other features and objects of the invention will become apparent as a preferred embodiment thereof is disclosed in the ensuing description and accompanying drawings.

DESCRIPTION OF THE DRAWINGS

FIG. 1 is a perspective of the complete tool.

FIG. 2 is an exploded perspective showing the tool cavity and the "pin cushion."

FIG. 3 is a plan view of the tool with the pin cushion removed.

FIG. 4 is a section on the line 4—4 of FIG. 1.

FIG. 5 represents an exemplary use of the tool.

DETAILED DESCRIPTION OF A PREFERRED EMBODIMENT OF THE INVENTION

The complete tool is best seen in FIG. 1 as comprising a main body or handle part (10) having oppositely extending fingers (12), each finger being relatively slender and thus of materially reduced cross-section as compared to the handle part, here depicted as being block-like in nature and having a top (14), a bottom (16), opposite sides (18) and opposite end portions (20). In a preferred construction, the handle and finger parts are integral with each other, being formed as a molded product of elastomer having a Durometer on the order of between 50 and 100, good results being obtained from a product having a Durometer of about 88, about equivalent to that of a typical automobile tire. Because of this nature of the product, the slender fingers flex or hinge relative to the handle part generally in the areas denoted by the numerals (22). See especially FIG. 5. The tool is easy to handle, being preferably about 4 inches in overall length, with the handle part about $1\frac{3}{4}$ inches $\times \frac{3}{4}$ inches and each finger about 5/16 inches square in cross section. These are, however, representative dimensions and, obviously can be varied.

Each finger (12) has a free terminal end portion (24) and each end portion is provided with fastener-grasping means, here a vertical through hole (26) extending between the top and bottom of the finger. It is preferred that the holes be of different diameters so as to accommodate fasteners of different sizes. In use, a selected fastener is inserted in a selected hole (26) and is driven partly into the work. In order to facilitate removal of the partly-driven fastener, each terminal end (24) has a slot (28) that intersects its bifurcated associated hole and each slot opens at the free end of the finger, giving the finger end a bifurcated configuration, whereby the finger may be withdrawn in a direction normal to the fastener. It is preferred that the slot extend past the hole toward the handle part in order to increase the flexibility of the thus bifurcated finger and thereby improve its grip on the fastener and also to enable the holes to accommodate different-sized fasteners. The height of the finger is such that in most cases the grasped fastener will project above the finger so as to be engaged by a driver; e.g., a hammer (FIG. 5). In using a staple, only one leg of the staple will be received by a hole (26). Since the tool material is relatively soft, "over-driving" of the fastener while held in the finger will not mar the work beneath the finger. The size of the tool enables it to be easily carried in the user's pocket. Also because of the nature of the material, the tool can handle magnetic fasteners. As an adjunct to easy handling of the tool, opposite sides of the handle are of concave configuration, as at (36), to afford finger and thumb grippable areas. FIG. 5 best shows the use of the tool in a situation where an offset (38) in the work are is involved.

A further feature of the tool is that it carries means for storing a supply of additional fasteners, as best seen in FIG. 4. An exemplary means for this purpose may be a block (30) or the like of porous or equivalent material that will function as a "pin cushion," a suitable product being that known as Styrofoam into which the fasteners may be inserted for easy storage and removal. The top portion of the handle part has means for carrying the storage means, in this case an upwardly opening rectangular cavity (32). A smaller hole (34) in the bottom of the handle leads to the cavity and enables the use of a finger or the like to push the block (30) out of the cavity. The hole (34) also serves as means hanging the tool on a hook or other suitable hanger.

The ends (24) of the fingers are shaped with corners (40) which are transversely aligned with the respective holes (26) and thus serve as guides or gages for lining up the holes with lines, scribe marks, etc., on layouts, the work, etc. Further, the nature of the material of which the tool is made permits the user to trim the terminal ends to suit particular "tight" places.

The tool is light in weight, inexpensive to manufacture and above all is easy to use in the solution to difficult problems. Features and advantages other than those pointed out will become apparent to those versed in the art, as will modifications in the preferred embodiment disclosed, all without departure from the spirit and scope of the invention.

I claim:

1. A fastener-handling tool for use in starting fasteners such as nails, brads, staples, screws and the like having a handle part including a top, a bottom, opposite sides and opposite ends and a relatively slender, elongated finger joined to the handle part as a reduced-section prolongation of said part and having a fastener-receiving through opening, characterized in that the handle part has a cavity opening at the handle part top and depending toward the bottom of said part, a pin cushion means for carrying a supply of fasteners, said pin cushion means comprising an element of porous material having a top portion overlying the handle part top and a portion integral with top portion and projecting downwardly into the cavity, said depending portion being dimensioned to fit relatively tightly in the cavity and being upwardly removable from the cavity.

2. The tool of claim 1, further characterized in that the handle part bottom has a through opening therein leading upwardly to the cavity for facilitating upward removal of the element from the cavity.

* * * * *